US005916095A

United States Patent [19]

Tamlyn

[11] Patent Number: 5,916,095

[45] Date of Patent: Jun. 29, 1999

[54] STARTER STRIP FOR WALL CONSTRUCTION

[76] Inventor: John Thomas Tamlyn, 10406 Cash Rd., Stafford, Tex. 77477-4492

[21] Appl. No.: 08/953,899

[22] Filed: Oct. 20, 1997

[51] Int. Cl.[6] ..... E04B 1/68

[52] U.S. Cl. ..... 52/58; 52/97; 52/293.1; 52/302.6; 52/520; 52/547; 52/551; 52/716.2; 52/717.05

[58] Field of Search ..... 52/520, 521, 543, 52/547, 551, 552, 553, 302.6, 716.1, 716.2, 717.05, 800.1, 800.11, 801.11, 478, 483.1, 764, 288.1, 293.1, 293.3, 58, 97

[56] References Cited

U.S. PATENT DOCUMENTS

| | | | |
|---|---|---|---|
| 1,624,121 | 4/1927 | Thiem | 52/371 |
| 2,249,125 | 7/1941 | Gabriel | 52/553 |
| 2,754,551 | 7/1956 | Legnaioli | 52/553 |
| 2,867,013 | 1/1959 | Haag et al. | 52/288.1 |
| 3,046,700 | 7/1962 | Davenport | 52/551 X |
| 3,173,229 | 3/1965 | Weber | 52/547 |
| 3,473,274 | 10/1969 | Godes | 52/543 X |
| 3,703,062 | 11/1972 | McKinney | 52/551 X |
| 3,925,952 | 12/1975 | Hagel et al. | 52/58 X |
| 4,272,576 | 6/1981 | Britson | 52/519 X |
| 4,348,849 | 9/1982 | Wollam et al. | 52/545 |
| 4,622,791 | 11/1986 | Cook et al. | 52/241 |
| 4,967,521 | 11/1990 | Pike | 52/58 X |
| 4,969,302 | 11/1990 | Coggan et al. | 52/309.8 |
| 5,003,743 | 4/1991 | Bifano et al. | 52/288.1 |
| 5,575,127 | 11/1996 | O'Neal | 52/551 X |
| 5,630,297 | 5/1997 | Rutherford | 52/58 |

*Primary Examiner*—Carl D. Friedman
*Assistant Examiner*—Laura A. Callo
*Attorney, Agent, or Firm*—Gunn & Associates

[57] ABSTRACT

A strip for protecting the lower edge of framing of a structure above foundation is disclosed. It attaches at the outer face of the foundation and framing to protect the interface. Moreover, it extends outwardly. In one embodiment, a normal shoulder or face abuts the marginal edge of sheet panel material. In another embodiment, an angle face is located so that the strip can be positioned under a first plank to define a sloping angle so that overlapped planks can be built on the exterior to shed rain.

13 Claims, 1 Drawing Sheet

STARTER STRIP FOR WALL CONSTRUCTION

BACKGROUND OF THE DISCLOSURE

In the construction of a residential dwelling, it is common to build the dwelling by first constructing a foundation. An example will be given referring to a slab foundation, but the problem remains the same for pier and beam foundations. The foundation is visible for a few inches above the grade, and is sometimes visible for greater heights. Typically, a large portion of the perimeter of the dwelling is erected with the foundation visible for perhaps 3 to 10 inches. Generally, some type of wall covering material is placed on the exterior above the foundation. In the past, the most common forms of wall covering material has included horizontal wood planking. Another common exterior is wood shingles in overlapped patterns. Generally, they are placed on the exterior wall with horizontal alignment. The bottom board, shingle or plank is then overlapped at the top edge by the next replicated member. This is done time and again to cover the entire wall. The assembled wall covering is a moisture barrier to prevent entry of water. It is especially important that water not get under that barrier. Some wall planks are fabricated with a notch cut along the edge of the plank to facilitate overlapping to shed water. By positioning one plank overhanging an adjacent plank, water is shed. This is highly protective so that water cannot enter the framing behind the wall planking. A problem arises, however, in that the bottommost plank typically is positioned where it must overhang the bottommost framing members behind the wall covering. The bottommost frame member may be exposed to water if the overlap is inadequate.

The bottom plank is parallel to and out board of the bottommost member, that being most typically a horizontal frame member known as a sole plate. The typical sole plate is a 2×4, which is parallel to the slab foundation. The 2×4 is an extremely basic frame member which, if exposed to water, will rot and create structural damage. Replacement of a sole plate is almost impossible without taking apart the entire wall because the studs in the frame are supported by it.

The bottom plank and the wall covering must protect the sole plate. Moreover, the bottom plank and the wall covering must provide protection against water entry to any of the frame. Water comes against the planks defining the wall in three forms. In part, it can be blowing rain. In part, it can be drainage from above, off the roof or down the face of the wall. There is, however, a third source of water which is especially focused at the bottom of the fabricated wall, i.e., in the region of the sole plate. That water entry involves splashing of water so that the water trajectory is upward toward the wall from a direction not automatically excluded by the overlap of adjacent planks. In particular, this defines a region below the bottommost plank and just behind it that can be exposed. Water entry, and especially splashed water entry, commonly causes rotting of the frame behind the wall covering.

The present disclosure is directed to a horizontally installed strip which is positioned adjacent to the sole plate to provide protection for the sole plate. It is preferably formed of plastic material, typically polyvinyl, and is well able to exclude entry of rain water. Especially, splashed water will not enter the wall. Better than that, splashed water is excluded by the strip of the present disclosure. The strip, however, serves an added feature. It is attached to the wall, parallel to and protective of the sole plate. In addition, it is attached to the wall to provide an angular prop so that the first plank is set at a desired angle applied to the wall construction. Because the strip has an angular face, it serves as a prop to angularly align the first plank installed on the wall. This defines the angle so that the overlap between planks can be achieved, thereby canting each plank for proper overlap. This avoids the added manufacturing cost of planks built with overlapping undercuts. That is much more expensive plank fabrication. By contrast, the present disclosure sets forth a strip which enables assembly of the wall, one plank at a time, without using specially-made planks. The canted angle is controlled by the strip of the present disclosure, applied to the first plank and thereby controls all additional planks placed on the wall.

The strip of the present disclosure has a specified height. That height is correlated to the width of a plank to thereby define the angular rotation at the time of strip installation. Consider, for instance, a six inch wide plank. If the plank is made of stock having a thickness of about one-quarter to one-half inch, it is desirable that each plank be canted so that the second plank laps over the first and is therefor rotated by the thickness of the first plank. In this regard, the strip of the present disclosure has a height providing the required canting for plank installation. All the several planks are then rotated as a result of this installation.

The first embodiment of the present disclosure is especially useful in wall construction where the wall is formed of planks having a riectangular profile. Regarding planks which are undercut to notch, it eliminates the need for that kind of notch so that plank installation can be done expeditiously. In an alternate embodiment, the strip is constructed with a height equal to the thickness of the wall covering material. New products recently introduced have added to the range of wall covering materials. Even older materials have been enhanced by this. For instance it is possible to construct a building, such as a dwelling, and cover the exterior with sheet, plank or lapped material. This material includes plywood and particle board. Recently, a newly introduced material includes the fiber-cement products of the James Hardie Building Products Company sold under the trademark Hardiplank. That is sheet material typically provided in plank form. The same source provides Hardipanel commonly, furnished in 4×8 sheets. Both of them can be finished to the taste or choice of the owner. The fiber-cement plank material typically has a thickness of about 5/16 inch, and not more that about 3/8 inch. Both of the plank and panel material, as well as other wall covering materials, are preferably installed over the sole plate. They often are terminated even with the sole plate. There is, however, a height limitation. Considering the framing, the standard wall covering material has a height to provide external sheath protection to a frame that is not precisely the same height. The frame construction normally has a height defined by assembled frame components. The assembled frame members include wall studs, which are just less than 8 feet long. They connect with frame members of a nominal 2 inch width at the top and bottom (meaning the sole plate). In actuality, a 2×4 really has a thickness of about 1.5 inches. This creates a modest mismatch in length of sheath material compared with the frame components that make up the wall. In turn, that creates a need for slightly extending the sheath covering. The sheath material is extended slightly so that the sheath material, in conjunction with an alternate form of the bottom strip of this disclosure, can be installed to protect the sole plate. The second embodiment, similar to the first, includes a vertical piece. It has a width equal to and preferably greater than the width of the sole plate. This enables the strip to be nailed on the outside of the sole plate to extend above the sole plate and below the sole plate so that the entire sole plate, at the exposed side, is covered over. This substantially prevents the entry of water. This will avoid rotting of the wood framing members. This also protects the wood frame members against splashed water directed at an upward angle under the overhanging wall covering material whether planking or paneling. Another aspect of both embodiments of the strip is that they serve an alignment function for the paneling or planking on the exterior. Another aspect of the present apparatus is that the strip material is easily installed with a minimum of nailing. Once it is nailed in place, and that step is accomplished easily, then the next step is easily done, also.

In summary, the present disclosure is directed to a strip for installation on a paneled or planked external wall. It protects the sole plate by installing adjacent to the sole plate. thereby excluding the entry of water into the frame. It keeps the sole plate safe from rotting by splashed water. It protrudes so that it lines up paneling or planking affixed to the exterior. Finally, it assures that the assembled wall thereabove is appropriately aligned with the exterior so that water shedding is accomplished.

BRIEF DESCRIPTION OF THE DRAWINGS

So that the manner in which the above recited features, advantages and objects of the present invention are attained and can he understood in detail, more particular description of the invention, briefly summarized above, may be had by reference to the embodiments thereof which are illustrated in the appended drawings.

It is to be noted, however, that the appended drawings illustrates only a typical embodiment of this invention and is therefore not to be considered limiting of its scope, for the invention may add to other equally effective embodiments.

DETAILED DESCRIPTION OF THE INVENTION

Figure 1:
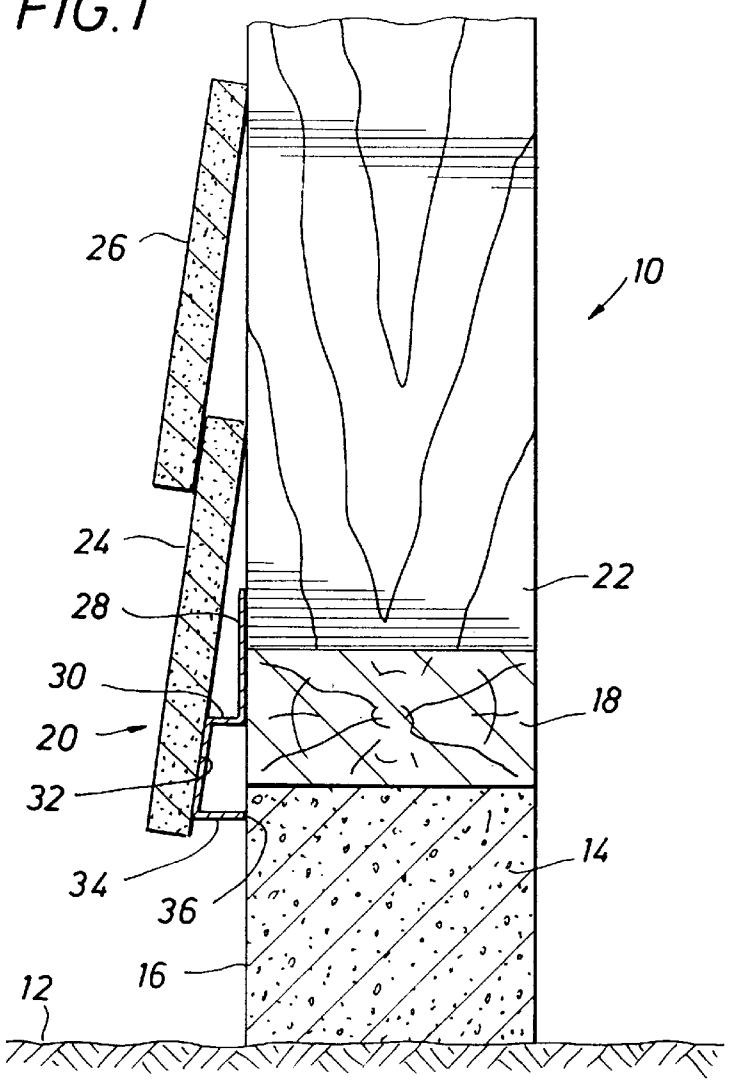
FIG. 1 is a sectional view through a fabricated wall protected by a first embodiment of the starter strip of the present disclosure illustrating protection of the sole plate and also showing canted installation of the planks.

Attention is first directed to FIG. 1 of the drawings where the numeral 10 identifies a wall that is constructed for some type of building. From the ground up, there is an open or exposed ground area 12, and a foundation 14 has been constructed on it. The foundation can either he pier and beam or slab construction. It has an exposed foundation face 16 which typically is exposed from about 2 inches up to about 10 or 12 inches. There are exceptions, one occurring commonly when the dwelling is on a grade which falls away from the area so that the foundation face may be wider. It is desirable that the foundation face 16 be sufficiently tall that most of the water splashing from the ground area 12 will not strike the wooden components thereabove, as will be detailed. Typically, the structure is built by forming the foundation in place and then attaching a sole plate 18 to the foundation. The sole plate is normally a 2×4. Technically, it has a thickness of about 1.5 inches. The wall construction is continued upwardly by installing wall studs 22 thereabove.

The first embodiment of the present invention is identified by the numeral 20. It is installed parallel to and on the outside of the sole plate. The wall is assembled on the studs 22 by nailing a parallel plank 24 to the studs 22. The single view illustrates a first plank 24 with a second plank 26 thereabove.

Turning for the moment from the planks. attention is momentarily directed to the strip 20. The type and style off construction of that strip will be detailed. The strip 20 has a length which is equal to the length of the wall. Typically, it is formed in standard lengths which can easily be cut with a pair of industrial size scissors. In the preferred form, the strip 20 is manufactured to lengths which can be readily shipped, although there is no particular length requirement. It is formed of polyvinyl or other plastic material which is relatively inexpensive. The thickness is typically a few mils, and typical ranges for the thickness are about 0.004 to about 0.02 inches. Moreover, it is colored polyvinyl. typically having a neutral color such as white (easily painted to any desired color). The strip has a special profile, as illustrated in FIG. 1 of the drawings. The strip 20 includes a planar back 28, which has a specified height, as illustrated in FIG. 1. The back 28 stands sufficiently tall that it extends above the sole plate 18, and also can optionally be extended below the sole plate to protect the outside or exposed sole plate face. The back 28 width is about ¾ inches to a total width of about 1½ inches. While it can be made wider, there is ordinarily no benefit to greater width than about 1½ inches total width. The back 28 is joined at the lower marginal edge (spanning the gap) by the three remaining planar portions. The strip 20 integrally joins to an upstanding face 30. The upstanding face 30 has a height, as will be discussed. The face 30 is at right angles to the back 28. This right angle construction locates the face 30 to support an angle face 32. The angle face 32 connects with the bottom face 34, which is at right angles to the back 28 and which extends below the sole plate 18 to protect the outside or exposed sole plate face. Between the parallel faces 30 and 34, the bIack 28 can effectively be omitted, as shown in FIG. 1, to reduce the weight of the strip 20.

The angle face 32 is used as a pedestal to align the plank 24. Perhaps some representative values will identify the angular offset. For a typical plank 24 that is an 8 inch wide plank, it is common that the planks 24 and 26 be overlapped by a suitable amount which is approximately 1¼ inches. As will be understood, if the angle face 32 is raised to an elevation approximately equal to the thickness of the plank, this is a height of something around ¼ to ½ inch. The angle face 32 is constructed with a slight angle in the manner illustrated.

The shaped sectional profile is formed by extrusion. The extruder mold is relatively simpler to construct with an open space behind the angle face 32 and between the faces 30 and 34. In actuality. this construction is relatively stiff notwithstanding the open side, as illustrated. Being relatively stiff, it can be subjected to the typical construction site bending and abuse which inevitably occurs. Nevertheless, it is a quality device which can be built in the manner described and installed in a routine fashion. If bent or dimpled, it will still maintain dimensional stability and is restored from the plastic memory to the shape illulstrated.

Consider now the installation of the strip 20. Before placing any of the planks on the framing, the normal construction procedure involves attachment of a vapor barrier, such as felt or tar paper on the exterior of the framed structure. Insulation material may by placed between the wall studs to support an outside vapor barrier. All of that is placed in the framed building before fastening the strip 20 on the structure. The strip 20 is nailed with just a few nails. It can be conveniently nailed to the sole plate 18. It is attached so that the back plate 28 stands above the sole plate to protect the sole plate. It is installed so that the lower face 34 is about ⅜ inches below the top of the slab 14. In fact. the lowermost bead 36 is torsionally rotated so that contact is made on the foundation 14. Finally, it is installed so that the strip is parallel to the sole plate covering the interface between wood and concrete. It the strip must be spliced. it can be cut so that there is a modest amount of overlap of the back plate 28. This normally assures adequate covering. After tacking in place with two or three nails, the next step is to install the plank 24. The plank 24 is positioned against the frame construction and is nailed in place. Typically few nails are placed in the plank to assure fastening. When the plank 24 is nailed in place it is set out at an angle, as illustrated. While the angle may be exaggerated in FIG. 1 for purposes of emphasis, proper positioning of the plank 24 is achieved. The next plank 26 is nailed above and overlapped as illustrated. This is continued up the wall until the entire wall has been planked. The strip 20 serves as a starter to get the right angle nor the plank 24 and to achieve the right position for protection of the frame behind the planking.

Figure 2:
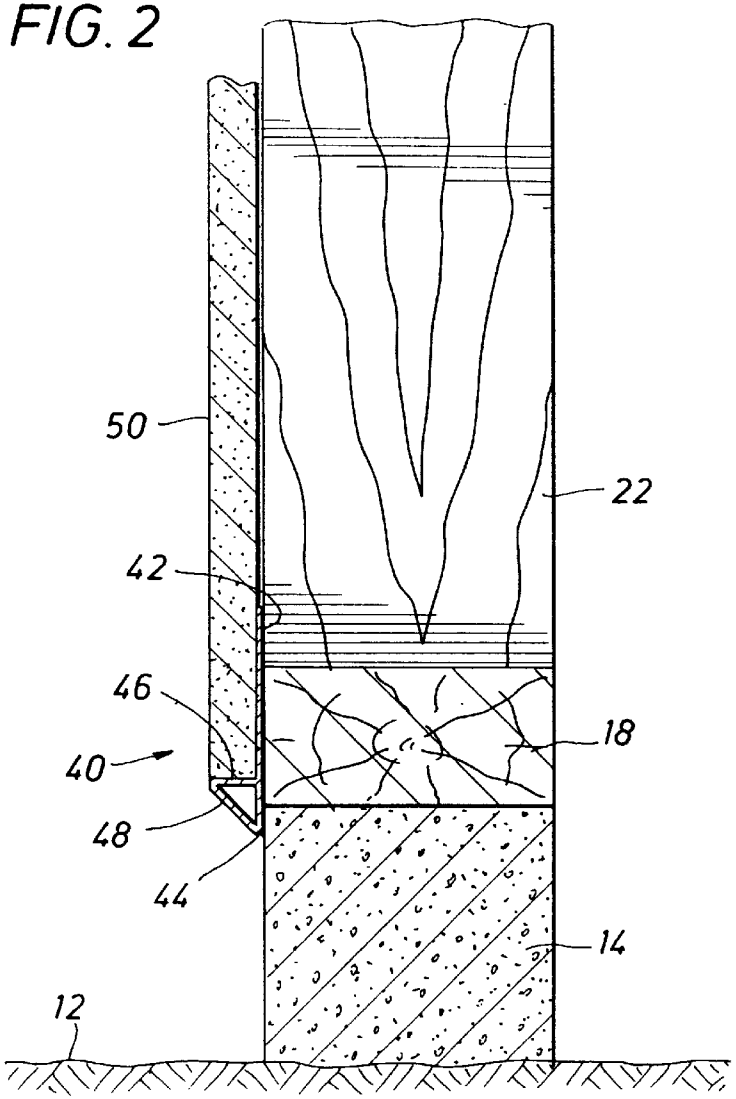
FIG. 2 shows an alternate embodiment which aligns sheet paneling material in accordance with the present disclosure.

Attention is now directed to FIG. 2 of the drawings where the foundation 14 again is illustrated above the ground surface 12. As before, it includes the sole plate 18 which connects with the 2×4 frame members 22. The studs are erected above the sole plate in the same fashion. As before, felt or tar paper is positioned on the exterior wall. The wall is normally fabricated to that stage at which time a starter strip 40 is attached. Details will be given regarding it later. The starter strip is positioned to cover over the sole plate. It provides a registration face for the panel member 50. The panel member can he waterproof plywood. particle board, and is preferably the Hardipanel fiber-cement material. in this instance, it is attached to the wall by nailing to the studs 22. Prior to the attachment of the panel member, the recistration surface is lined up so that registration can be easily done. More than that, the registration strip protects the sole plate, as will be detailed.

The strip 40 has a back plate 42. It has sufficient width so that it extends above and below the sole plate 18. When mounted, it extends down in front of the foundation 14 to the lower bead 44. The strip 40 is formed of plastic polyvinyl material and has a thickness of sufficient strength to enable it to hold a nail without splitting. The strip is nailed in place in the same fashion as the embodiment 20. When nailed, the strip is horizontal. Typical width of the back plate is about 1½ inches. While it can be wider, there is no significant gain to makings it wider, but it is desired that the width at least exceed the width of the sole plate, which is a minimum of 1.5 inches. Ideally, it is about 1½ inches to assure that the sole plate is covered with the full width extending below the sole plate. Again, this is to stop splashed water from the ground 12 contacting the sole plate.

The panel material 50 is typically provided in a thickness between about ¼ and ½ inches. Therefore, the strip 40 has a width at the face 46 equal to the width of the strip. This covers the bottom edge or face of the strip of the panel 50. Normally, the panel is formed of moisture resistant materials including the fiber-cement product previously mentioned. Sheet plywood is especially vulnerable to the entry of water at the butt end. While the face or surface may be waterproof, it is especially important to protect against the intrusion of water at the end of the sheet, i.e., the face which is covered by the face plate 46 of the strip 40. In that particular instance, the strategic positioning of the face 46 at the illustrated location assures that water does not enter the sheet plywood. With other panel products, it may be less critical. Suffice it to say, the construction of the embodiment 40 involves positioning of the face 46 normal to the back plate 42. The remaining face 48 is at an angle to provide a cosmetic trim. On a casual look from any distance, the face 48 will have the appearance of a molding strip, or might be mistaken for caulking or other material placed along that location. Since it is primarily functional as opposed to cosmetic, this is a desirable benefit.

The embodiment 40 is made with a width of about 1½ inches for the back plate 42 and a height between ¼ and ½ inch for the face 46. That is preferably matched to the thickness of the panel 42. The strip is nailed to the frame of the structure. It is placed over the sheet of felt paper or other vapor barrier. After positioning, it is preferably tacked in place with a few nails or other fasteners. Thereafter the panel 50 is held in position and is anchored in place with a number of nails. Typically, nails are placed at the upper end and preferably at least two or three are placed across the lower end of the panel 50. When nails are driven along the lower marginal edge of the panel 50, they will pass through the back plate 42 and anchor it in greater fashion.

The two embodiments of the present disclosure utilize similar back plates. They have a thickness extending out from the back plates which is tied to the thickness of the planking in FIG. 1 or the panel 50 in FIG. 2. In both instances, the strips 20 and 40 are constructed so that they have the requisite dimensional stability, rigidity with flexibility. and durability to outlast the dwelling or other structure. The preferred stock is extruded polyvinyl to the thickness indicated, and it is preferably colored with a dye at the time of extrusion so that it is colorfast and made of a uniform color through the plastic structure. This assures a durable and lasting strip. In both instances, the strips are installed just over the sole plate 18 to protect it at the exposed area. One aspect of this installation is the added security of shedding water so that it does not flow by capillary action into the gap between the foundation and the base plate.

While the foregoing is directed to the preferred embodiment, the scope is determined by the claims which follow.

I claim:

1. A strip for use in a fabricated wall, the strip comprising:

(a) an elongate back plate having a width equal to or larger than a specified width; and (b) transverse first, second and third protruding plates attached to and having a specified height above said back plate so that said strip has a portion overhanging an interface between a wall frame and a foundation therebelow, and extends below that interface, and said transverse protruding plates extend outwdardly by a specified distance to control spacing and placement of wall coverina material attached on the outside of the frame above the frame and foundation interface; wherein (c) said second plate is attached to said first and third plates to slope downwardly toward said foundation thereby shielding said interface from splash water and said first, second and third protruding plates connect to define a closed triangle in section.

2. The strip of claim 1 wherein said first protruding plate receives an end of a sheet of said wall covering.

3. The strip of claim 2 wherein said back and said first protruding plate are at right angles.

4. The strip of claim 3 wherein said strip is attached to a vertical surface of said frame by means of nails driven through said strip into said frame.

5. The strip of claim 4 wherein said first protruding plate has width equal to the width of said sheet of said wall covering.

6. The strip of claim 1 wherein said first protruding plate extends along and beneath a sheet of said wall covering and said back plate is equal to or greater in width than a frame member at the interface of the foundation to cover over the frame member.

7. The strip of claim 6 wherein said back plate is wider than said frame member and extends below said interface.

8. The strip of claim 7 wherein said back plate is polyvinyl and covers over the frame member to exclude splashed rain water.

9. The strip of claim 8 wherein said back plate comprises top and bottom edges and said first protruding plate is at right angles for positioning below said sheet of said wall covering.

10. The strip of claim 9 wherein said top and said bottom edges are spaced about one and one half inches thereby defining a width of said back plate.

11. The strip of claim 9 wherein said first strip has a width at the face of about one fourth inch to one half inch.

12. The strip of claim 1 wherein said strip comprises extruded polyvinyl.

13. The strip of claim 12 wherein said polyvinyl is colored.

* * * * *